US009061742B2

(12) United States Patent
Becker et al.

(10) Patent No.: US 9,061,742 B2
(45) Date of Patent: Jun. 23, 2015

(54) ARTICULATED TUG BARGE, TRAILING SUCTION HOPPER DREDGE SYSTEM

(75) Inventors: Steve Becker, Downers Grove, IL (US); David Coombs, LaGrange, IL (US); Paul LaMourie, Naperville, IL (US)

(73) Assignee: Great Lakes Dredge and Dock Company, LLC, Oak Brook, IL (US)

( * ) Notice: Subject to any disclaimer, the term of this patent is extended or adjusted under 35 U.S.C. 154(b) by 175 days.

(21) Appl. No.: 13/567,842

(22) Filed: Aug. 6, 2012

(65) Prior Publication Data

US 2013/0032073 A1 Feb. 7, 2013

Related U.S. Application Data

(60) Provisional application No. 61/515,699, filed on Aug. 5, 2011.

(51) Int. Cl.
*B63B 35/70* (2006.01)
*B63B 21/56* (2006.01)

(52) U.S. Cl.
CPC ..... *B63B 21/56* (2013.01); *B63B 35/70* (2013.01)

(58) Field of Classification Search
CPC ..... B63B 21/56; B63B 35/70
USPC ..... 114/26–38, 247–252; 701/21
See application file for complete search history.

(56) References Cited

U.S. PATENT DOCUMENTS

| | | | | |
|---|---|---|---|---|
| 3,919,790 | A * | 11/1975 | Sasaki et al. | 37/329 |
| 4,805,548 | A | 2/1989 | Yamaguchi | |
| 4,872,118 | A * | 10/1989 | Naidenov et al. | 701/124 |
| 5,050,522 | A | 9/1991 | Yamaguchi et al. | |
| 6,612,253 | B1 | 9/2003 | Kuhlman | |
| 6,836,746 | B2 * | 12/2004 | Coder et al. | 702/174 |
| 7,270,070 | B1 * | 9/2007 | Kuhlman et al. | 114/248 |
| 2011/0061581 | A1 | 3/2011 | Sadakuni | |
| 2011/0120363 | A1 | 5/2011 | Yamaguchi et al. | |

* cited by examiner

*Primary Examiner* — Edwin Swinehart
(74) *Attorney, Agent, or Firm* — Foley & Lardner LLP

(57) ABSTRACT

An articulated tug barge hopper dredge including a tug, a barge, and a coupling system configured to interconnect the tug and the barge. The tug has a bow and the barge has a notch in a periphery of the barge. The notch is sized to receive the bow of the tug. The articulated tug barge hopper dredge further includes dredging machinery integrated with the barge and configured to excavate material dredged from the seabed. The dredging machinery includes trailing suction pipes.

19 Claims, 14 Drawing Sheets

FIG. 5B

DETAIL A
DRAFT SENSOR & PIPING ASSEMBLY
ELEVATION

DETAIL B
VALVE INSTALLATION AT BOTTOM SHELL
ELEVATION

DETAIL C
VENT INSTALLATION AT DECK ELEVATION

DETAIL D
PROXIMITY SENSOR LOCATIONS
ELEVATION VIEW

ARTICULATED TUG BARGE, TRAILING SUCTION HOPPER DREDGE SYSTEM

CROSS-REFERENCE TO RELATED APPLICATIONS

The present application claims priority to U.S. Provisional Patent Application No. 61/515,699, filed Aug. 5, 2011, the contents of which are incorporated herein by reference in their entirety.

BACKGROUND

The present disclosure relates generally to the field of articulated tug barges. More specifically the present disclosure relates to a trailing suction hopper dredge configured as an articulated tug barge, and a system for coupling a tug and a barge of an articulated tug barge.

BRIEF DESCRIPTION OF THE FIGURES

The disclosure will become more fully understood from the following detailed description, taken in conjunction with the accompanying figures, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
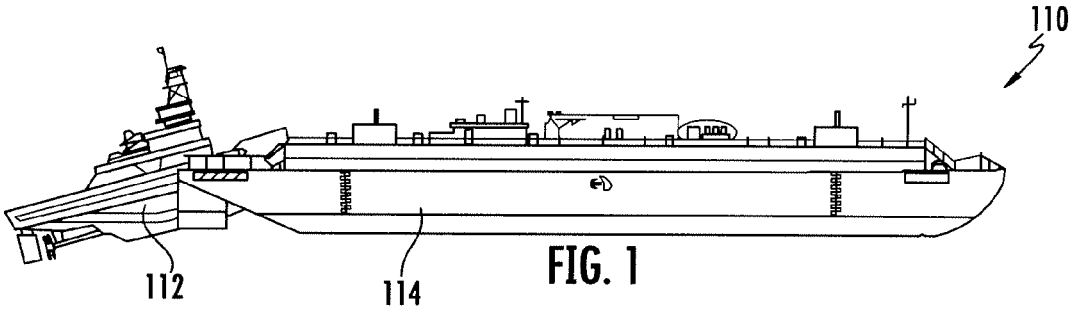
FIG. 1 is side elevation view of an articulated tug barge according to an exemplary embodiment.
Figure 2:
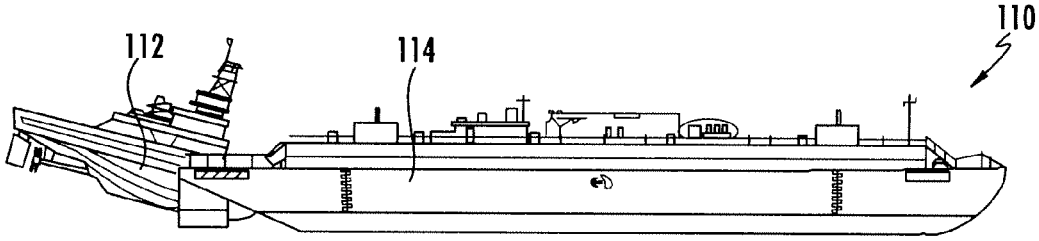
FIG. 2 is a side elevation view of the articulated tug barge of FIG. 1 in a second configuration.
Figure 3:
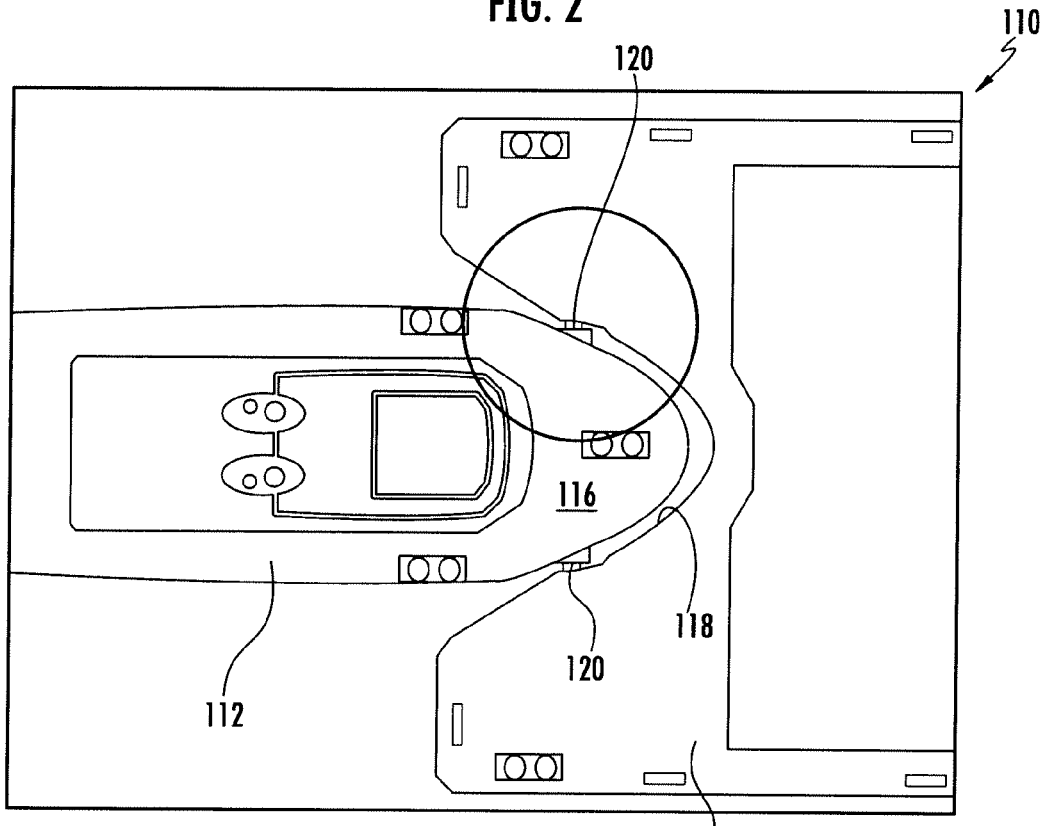
FIG. 3 is a top plan view of the articulated tug barge of FIG. 1 showing a connection of the tug and barge.

Referring to FIGS. 1-3, an articulated tug barge 110 includes a tug 112 (e.g., tugboat) and a barge 114. The tug 112 may operate connected to or disconnected from the barge 114. The tug 112 moves the barge 114, which may be loaded with dredged material.

According to an exemplary embodiment, the articulated tug barge 110 is designed to be used for the dredging and transportation of dredged material; much like a self-propeller trailing suction hopper dredge. In other embodiments, an articulated tug barge may be used for other purposes, such as the transportation of oil.

When connected to one another, the tug 112 and the barge 114 are not fixed together with respect to all degrees of freedom. Referring specifically to FIG. 3, the tug 112 may be pinned on both sides of the bow 116 of the tug 112 to a notch 118 (e.g., slip) in the periphery of the barge 114, which may be formed in the stern (e.g., rear) of the barge 114 (contrast FIGS. 4A and 5A with FIGS. 4B and 5B). As best shown in FIG. 3, the pins 120 connect the tug 112 and the barge 114, while allowing pitch rotation of the tug 112 relative to the barge 114 (shown in FIGS. 1-2). As such, the tug 112 may rotate about an axis defined between the pins 120 on both sides of the bow 116. In other embodiments, an articulated tug barge may incorporate a third pin system comprising a third pin (not shown) that would not allow the tug 112 to pitch relative to the barge 114. The third pin may be located in the front of the bow and in the forward-most interior of the notch 118, and may include any of a wide variety of known couplings configured to limit pitch rotation (e.g., hook, latch, etc.).

Figure 4A:
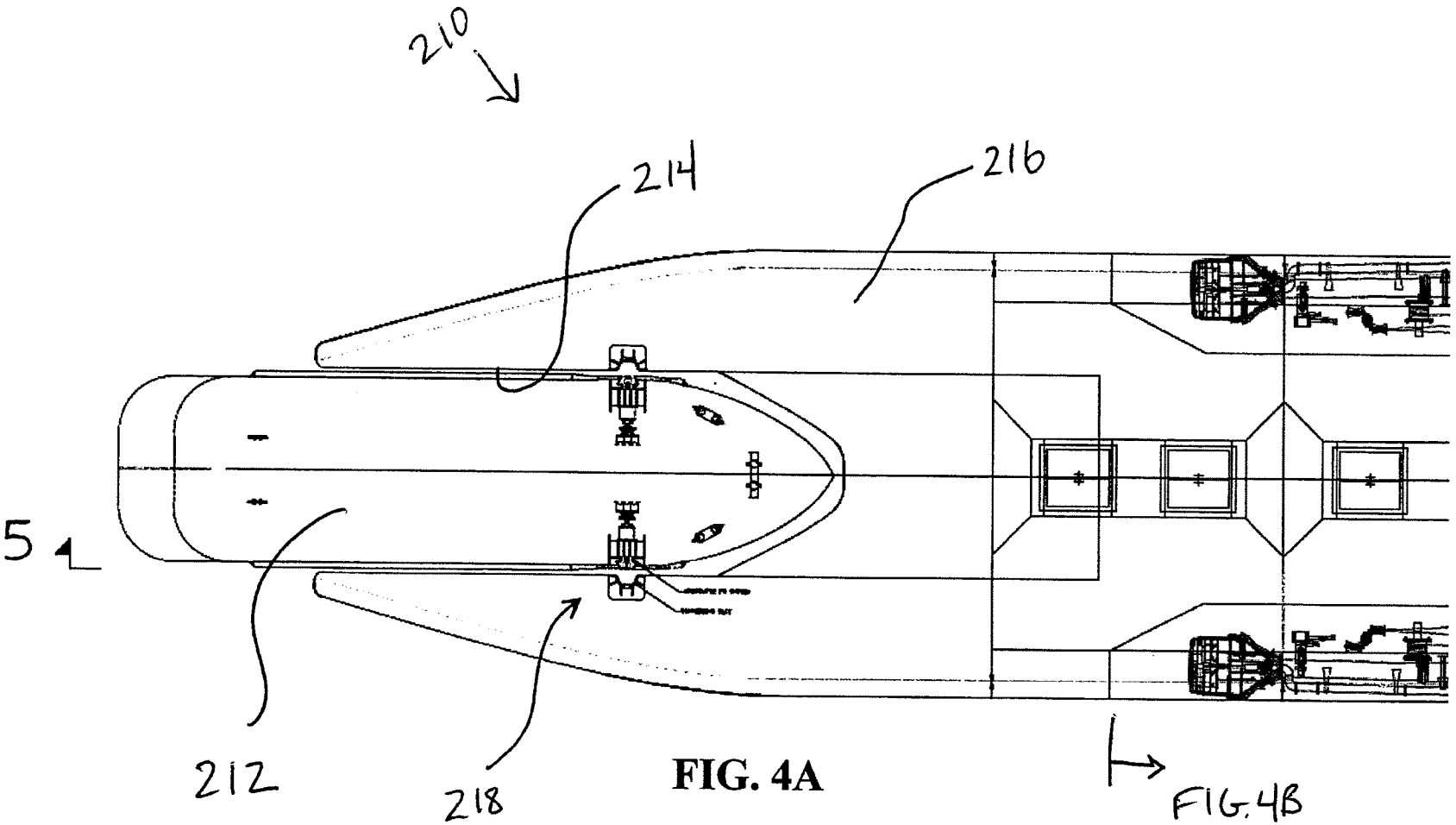
FIGS. 4A-4B are top plan views of stern and bow portions, respectively, of the barge of an articulated tug barge according to an exemplary embodiment.
Figure 4B:
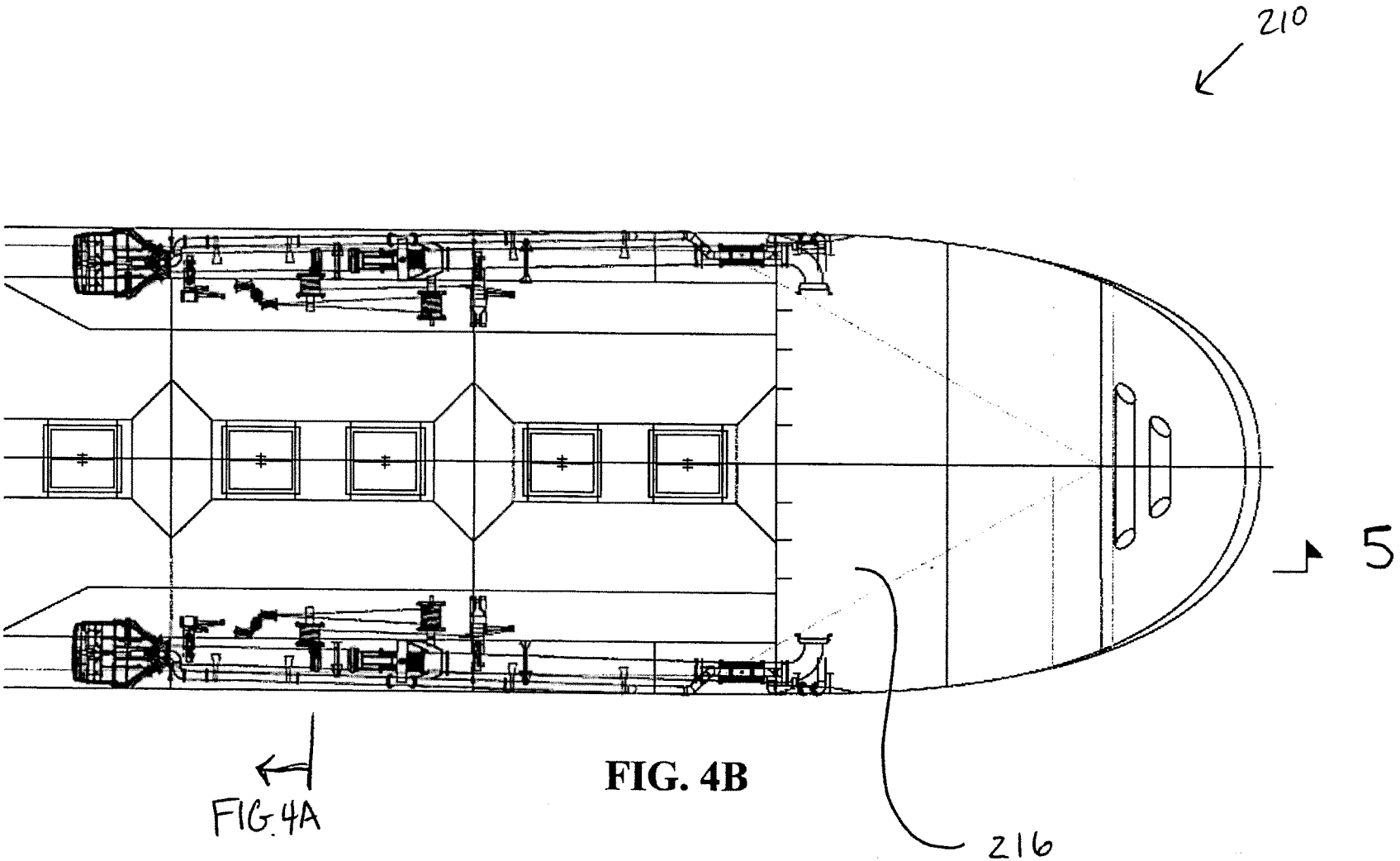
Figure 5A:
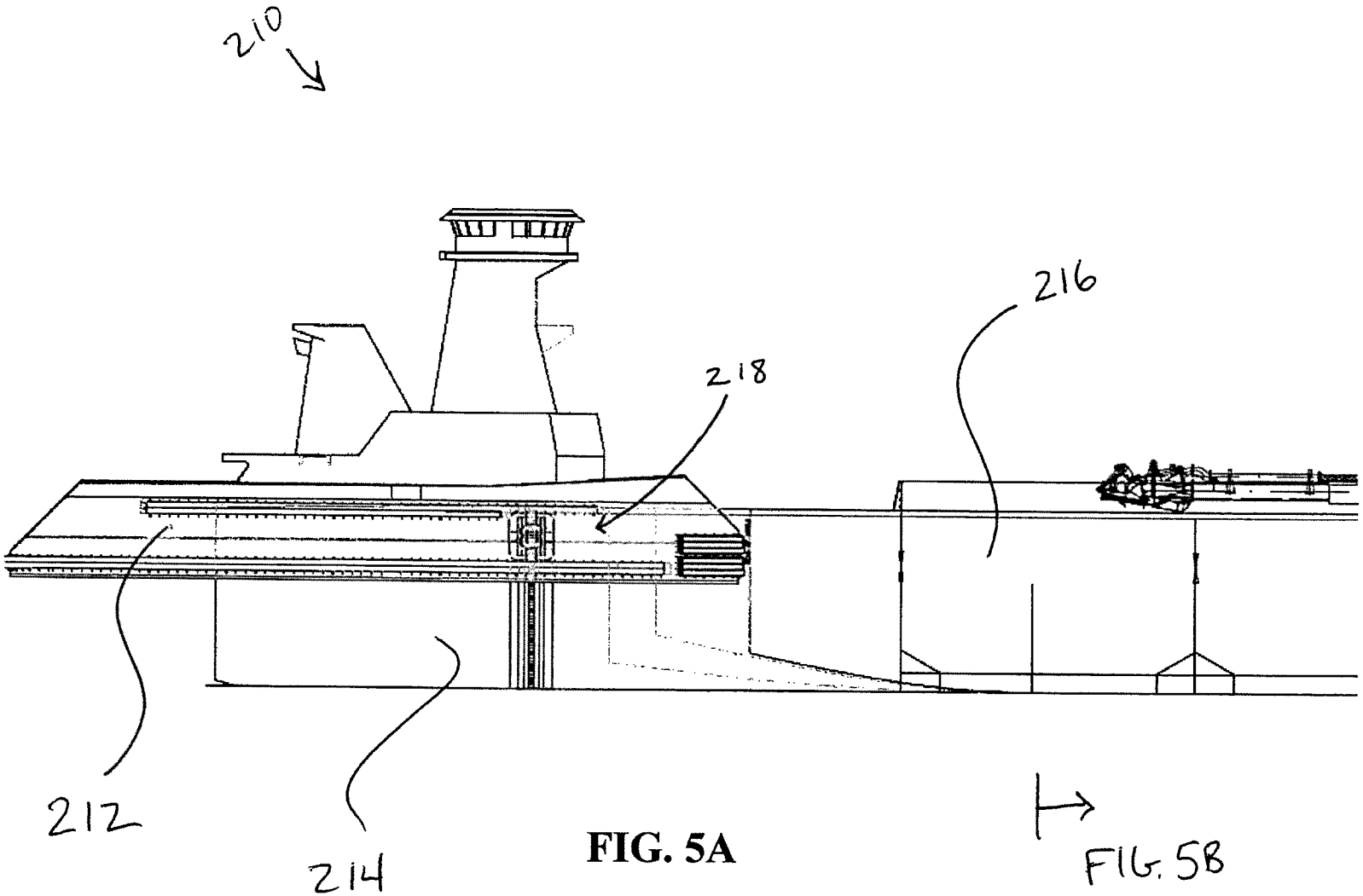
FIGS. 5A-5B are sectional views of the stern and bow portions of the barge shown in FIGS. 4A-4B, respectively, taken along line 5-5 of FIGS. 4A-4B.
Figure 5B:
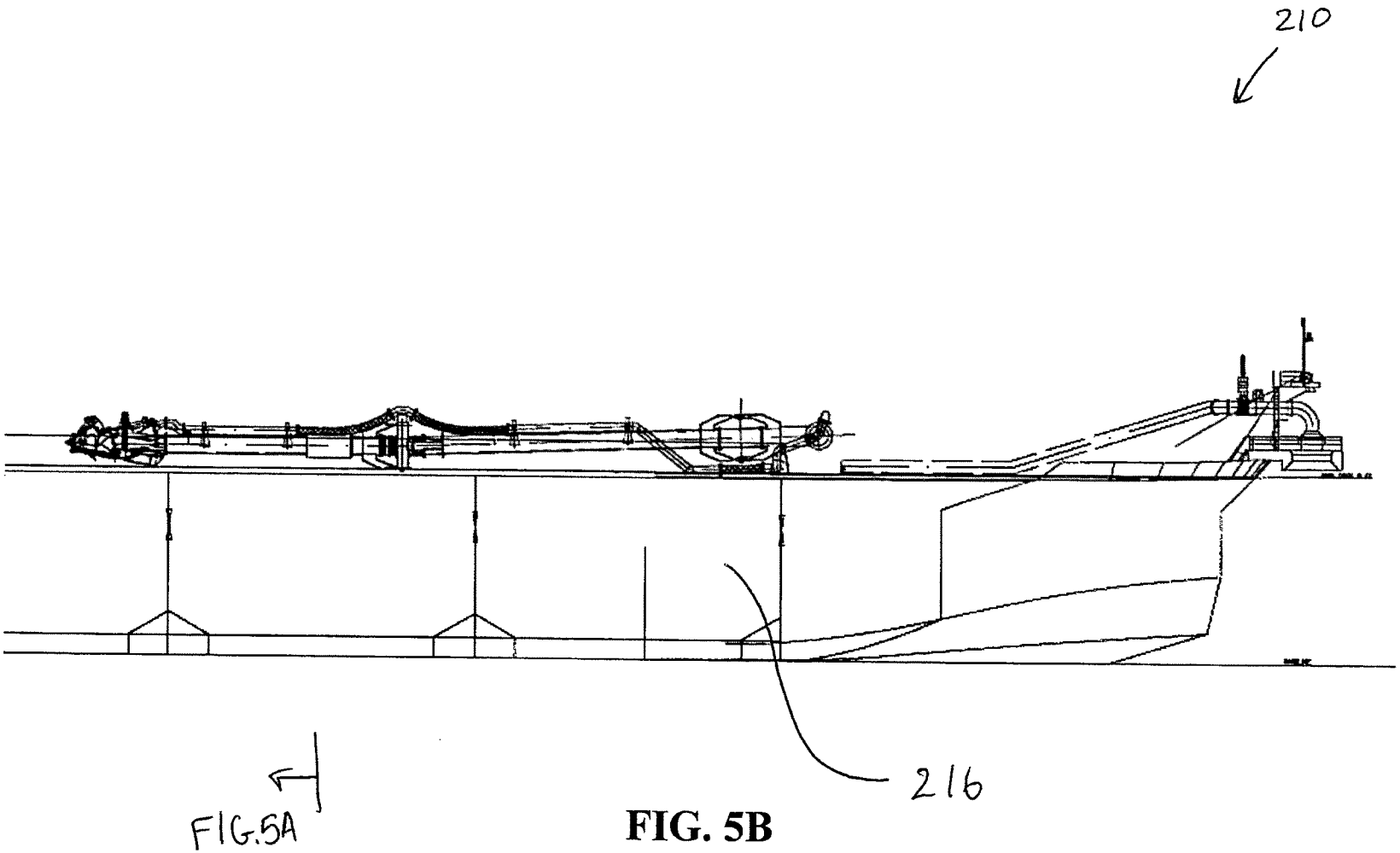

Referring to FIGS. 4A, 4B, 5A, and 5B, a trailing suction hopper dredge includes a dual-mode articulated tug barge 210. FIGS. 4A and 5A show the stern of the articulated tug barge 210, and FIGS. 4B and 5B show the bow of the articulated tug barge 210. In contrast to traditional trailing suction hopper dredges in the form of single-hulled ships, the dual-mode articulated tug barge 210 includes a tug 212 (shown in FIGS. 4A and 5A) that fits in a notch 214 behind a barge 216, where the tug 212 and the barge 216 are connected to one another via a coupling system 218 (e.g., an interconnect system). The barge 216 includes trailing suction pipes and other dredging equipment and machinery found on trailing suction hopper dredges, enabling the barge 216 to excavate dredged material from the seabed. For this reason, the barge 216 is also referred to as the "dredge" in the context of the articulated tug barge trailing suction hopper dredge. No additional hopper dredge ship is required.

Some advantages associated with the articulated tug barge 210 (in particular embodiments) as opposed to a traditional, hopper dredge ship, are as follows. In the embodiments described herein, the articulated tug barge 210 may be constructed in separate pieces: the tug 212 and the barge 216. For regulatory purposes, in terms of rules for construction, required equipment, etc., the tug 212 may be manufactured according to rules for vessels under a particular length, such as 90 meters, and the barge 216 may be manufactured according to barge rules. Simplified regulations associated with smaller vessels and barges may result in reduced construction costs.

Construction of a traditional hopper dredge ship may be limited to only a few shipyards in the U.S. that have the interest or capability to build such a commercial ship. Furthermore, high outfitting and machinery requirements associated with the traditional hopper dredge ships may be difficult for such ship yards. By contrast, the tug 212 according to the various embodiments described herein may be built in a ship yard specializing in tugs, and the barge 216 may be built in a ship yard specializing in barges. Furthermore, because the tug 212 and barge 216 may be constructed in separate ship yards, construction may be done in parallel, potentially reducing the time-to-market and resulting in construction period financing benefits.

Manning requirements of the tug 212 may include nine personnel in some embodiments, and licensing requirements may be less onerous in many respects than the licensing requirements of a ship. Legal manning requirements for the barge 216 may be zero, because the barge 216 may be considered "unmanned." As such, the owner of the articulated tug barge 210 may be free to determine the actual manning of the barge 216. In sum, the combined manning requirements of the articulated tug barge 210 may be about eleven to fourteen personnel, while the manning requirements of a similarly sized ship may be about eighteen to twenty-two personnel.

Additionally, it should be noted that the cargo capacity of a traditional hopper dredge ship is based on the displacement of the ship as well as the lightship weight, which includes propulsion engines, generators, accommodations structures, fuel, and other ship installations. The lightship weight deducts from the cargo-carrying capacity of the ship. However, the articulated tug barge 210 according to various embodiments includes in the tug 212 at least some of the features associated with the lightship weight. Accordingly, the weight of those features does not deduct from the cargo capacity of the barge 216. The draft 212 of the tug remains constant as the draft of the barge 216 increases due to increased load.

Still further, insurance premiums may be reduced for the articulated tug barge 210 according to various embodiments relative to a traditional hopper dredge ship. In some cases, the insurance premiums may be reduced because the chance of losing both the tug 212 and barge 216 may be less than the chance of losing a single ship.

According to an exemplary embodiment, the coupling system 218 is configured to rigidly connect the tug 212 and the barge 216 in at least some degrees of freedom (directions of translation and rotation) but not other degrees of freedom. According to an exemplary embodiment, the coupling system 218 is configured to rigidly connect the tug 212 and the barge 216 with respect to heave, surge, sway, roll, and yaw of the tug 212 relative to the barge 216, while allowing relative motion between the tug 212 and the barge 216 with respect to pitch rotation, which may improve propulsion performance and efficiency of the tug 212.

According to an exemplary embodiment, the coupling system 218 is further configured to allow the draft of the tug 212 and the draft of the barge 216 to change relative to each other while the articulated tug barge 210 is operating in a seaway (i.e., in sea conditions). In various embodiments, the coupling system 218 is configured to allow for controlled adjustment in the vertical direction of the connection, while allowing for continuous freedom of pitch of the tug and maintaining interconnection between the tug 212 and the barge 216 with respect to some or all of the surge, sway, yaw, and roll degrees of freedom.

Accordingly, in various embodiments the coupling system 218: (1) interconnects the tug 212 and the barge 216 with respect to some or all translational degrees of freedom (e.g., limits surge and sway of the tug 212, but may allow heave) and some or all rotational degrees of freedom (e.g., limits yaw and roll, but not pitch); (2) allows for draft adjustments of the tug 212 while operating in a seaway because interconnection between the tug 212 and the barge 216 is maintained with respect to two of the translational and two of the rotational degrees of freedom; (3) allows the tug 212 to pitch relative to the barge 216; and (4) allows the tug 212 to fully disconnect from the barge 216 such that the tug 212 may be used to perform duties in addition to moving the barge 216, such as towing ships or other barges.

Referring to FIGS. 6-9, a first part 310 (e.g., male connector, ram) of a coupling system, such as the coupling system 218 shown in FIGS. 4A and 5A, includes a pressing shoe 312 (e.g., first interface, connector, surge interlock) and a rack pin 314 (e.g., pin, second connector, heave interlock). The pressing shoe 312 and the rack pin 314 are configured to extend (e.g., move outward, project, translate) on a connecting pin 316 relative to a base 318 of the first part 310 of the coupling system, such as by way of an integrated hydraulic cylinder, a solenoid, or other linear actuators. Furthermore, the pressing shoe 312 and the rack pin 314 are configured to rotate about a main bearing 320 integrated with the first part 310 of the coupling system, which may allow for freedom of pitch between the tug and barge when the coupling system is engaged.

Figure 6:
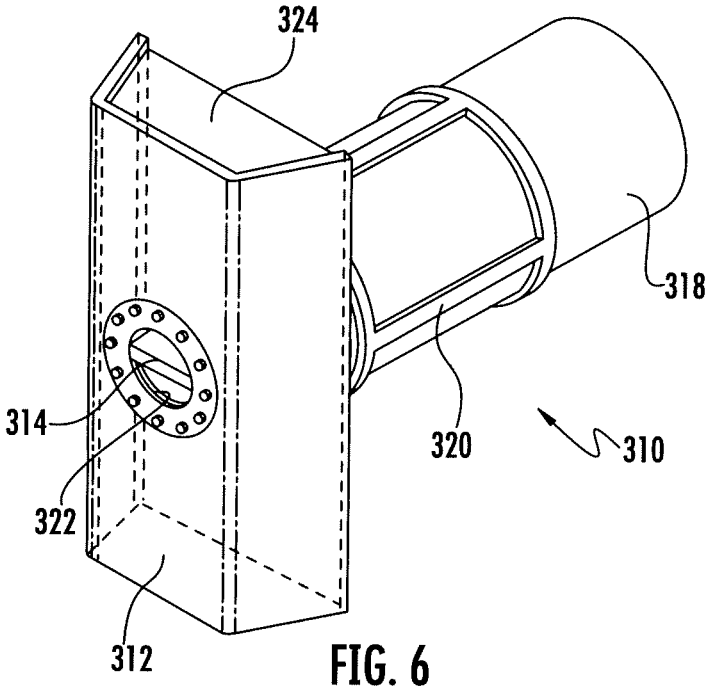
FIG. 6 is a perspective view of a first part of a coupling system according to an exemplary embodiment.
Figure 7:
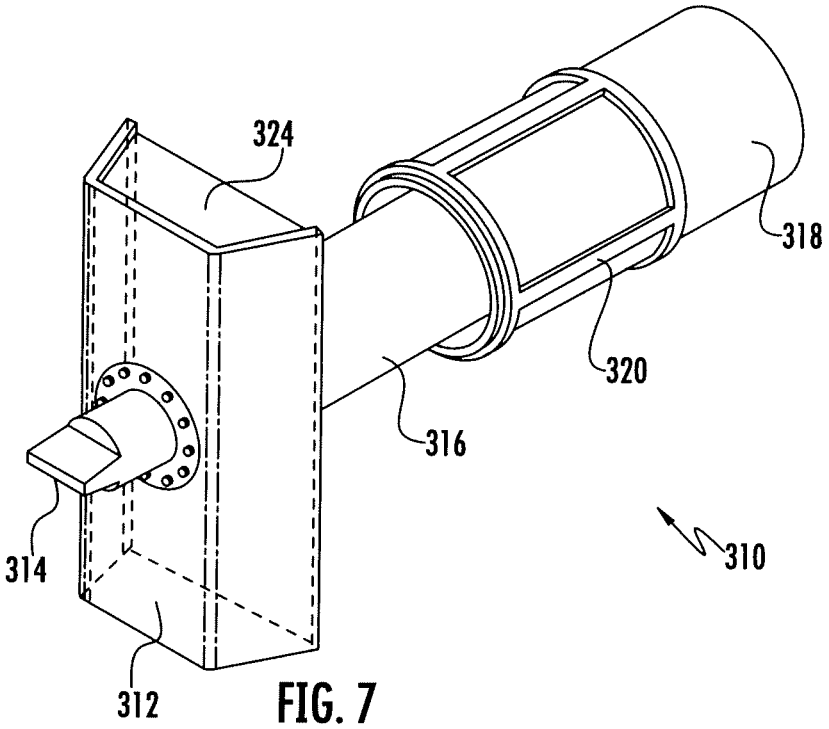
FIG. 7 is a perspective view of the first part of the coupling system of FIG. 6 in another configuration.
Figure 8:
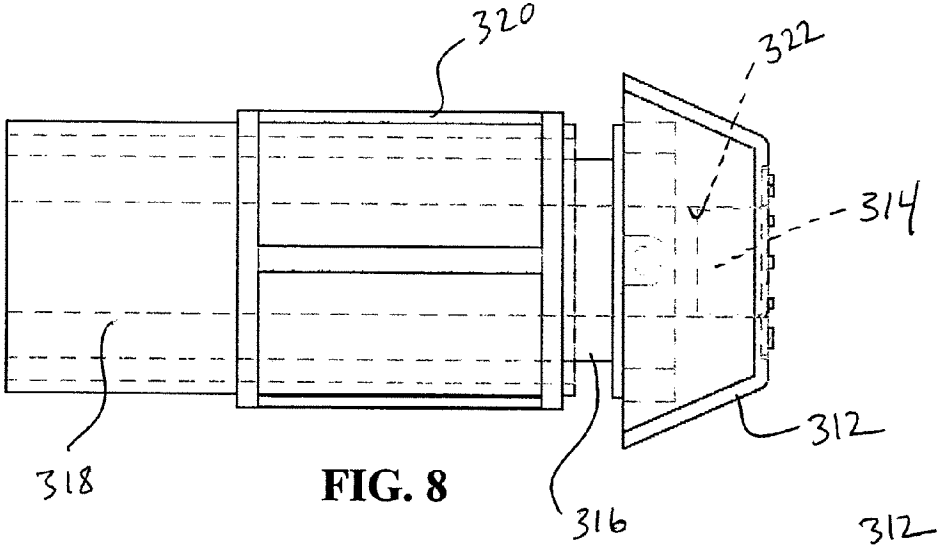
FIG. 8 is a top plan view of the first part of the coupling system of FIG. 6 in the configuration of FIG. 6.
Figure 9:
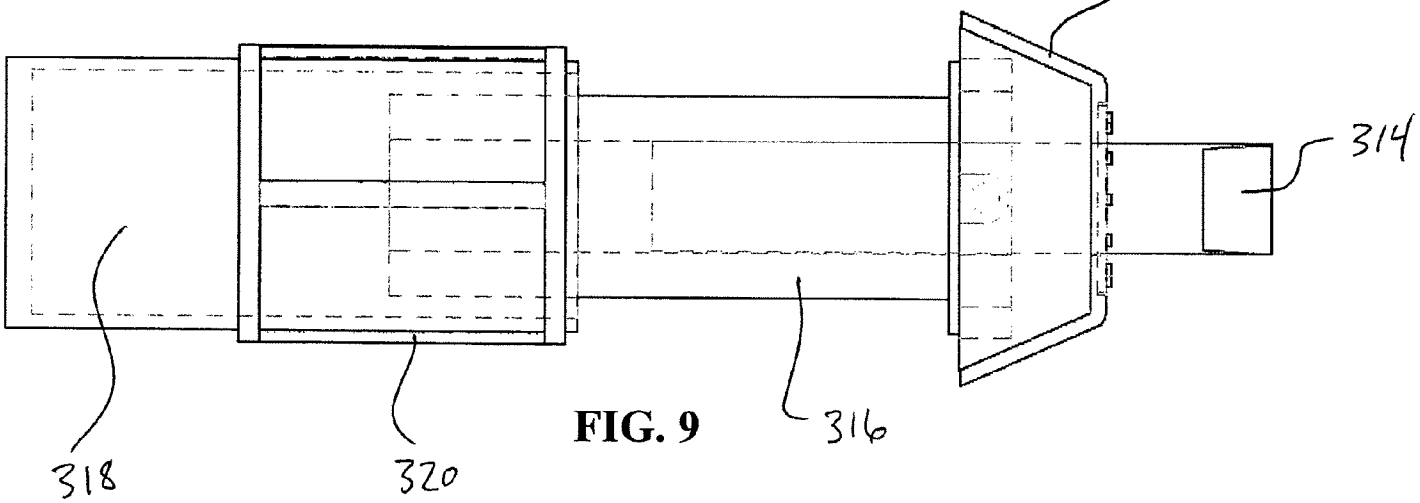
FIG. 9 is a top plan view of the first part of the coupling system of FIG. 6 in the configuration of FIG. 7.
Figure 10:
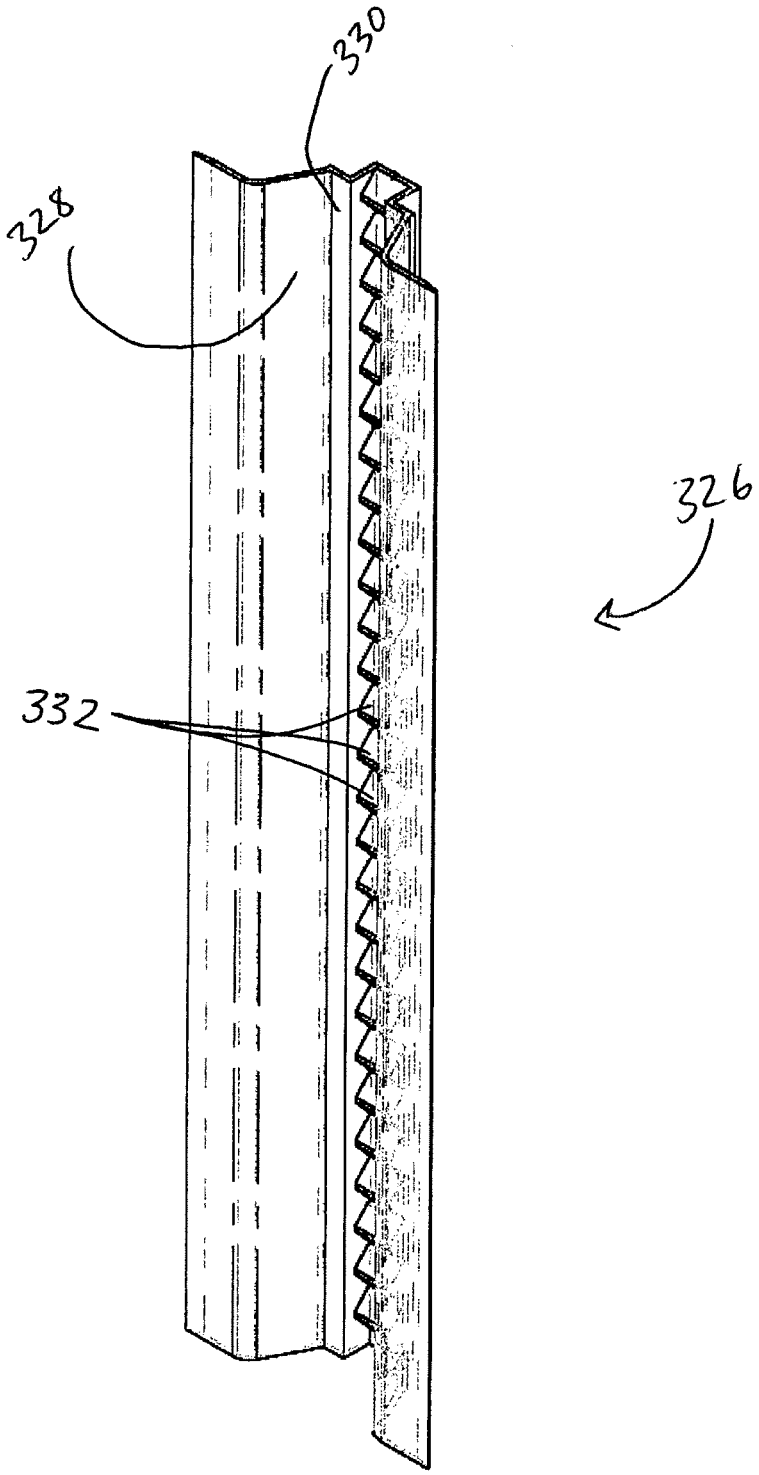
FIG. 10 is a perspective view of a second part of the coupling system according to an exemplary embodiment.
Figure 11:
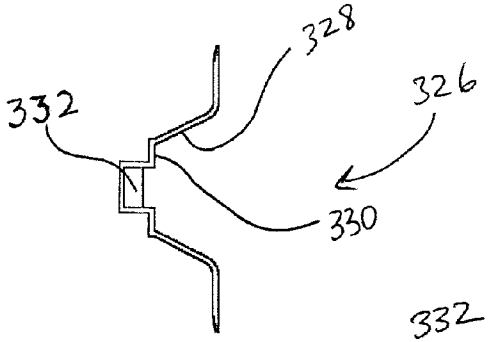
FIG. 11 is an end elevation view of the second part of the coupling system of FIG. 10.
Figure 12:
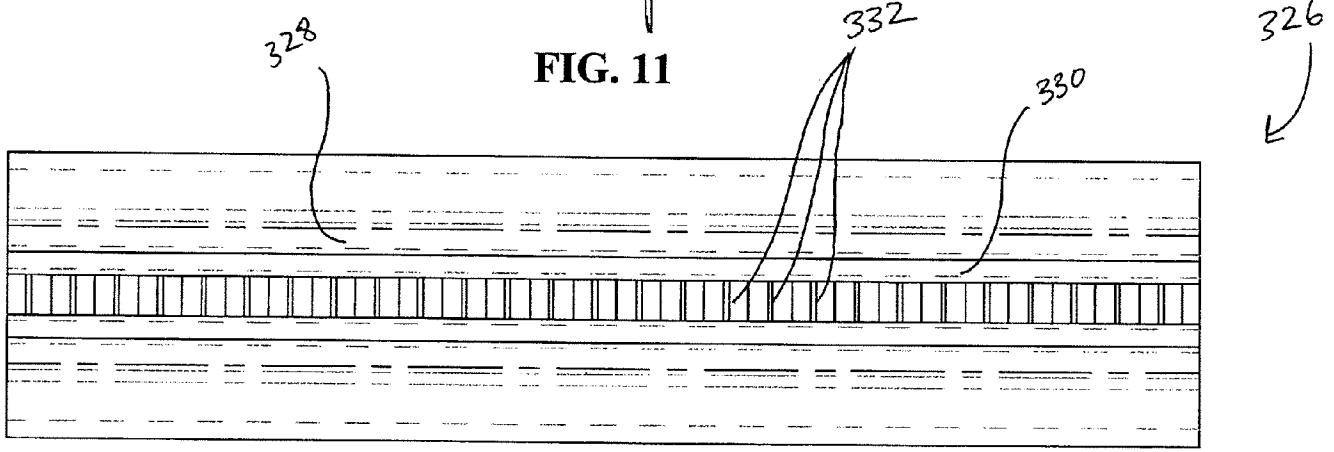
FIG. 12 is a front elevation view of the second part of the coupling system of FIG. 10.
Figure 13:
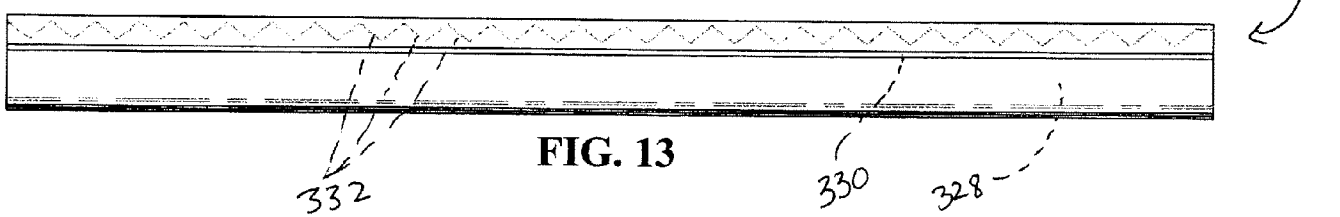
FIG. 13 is a side elevation view of the second part of the coupling system of FIG. 10.
Figure 14:
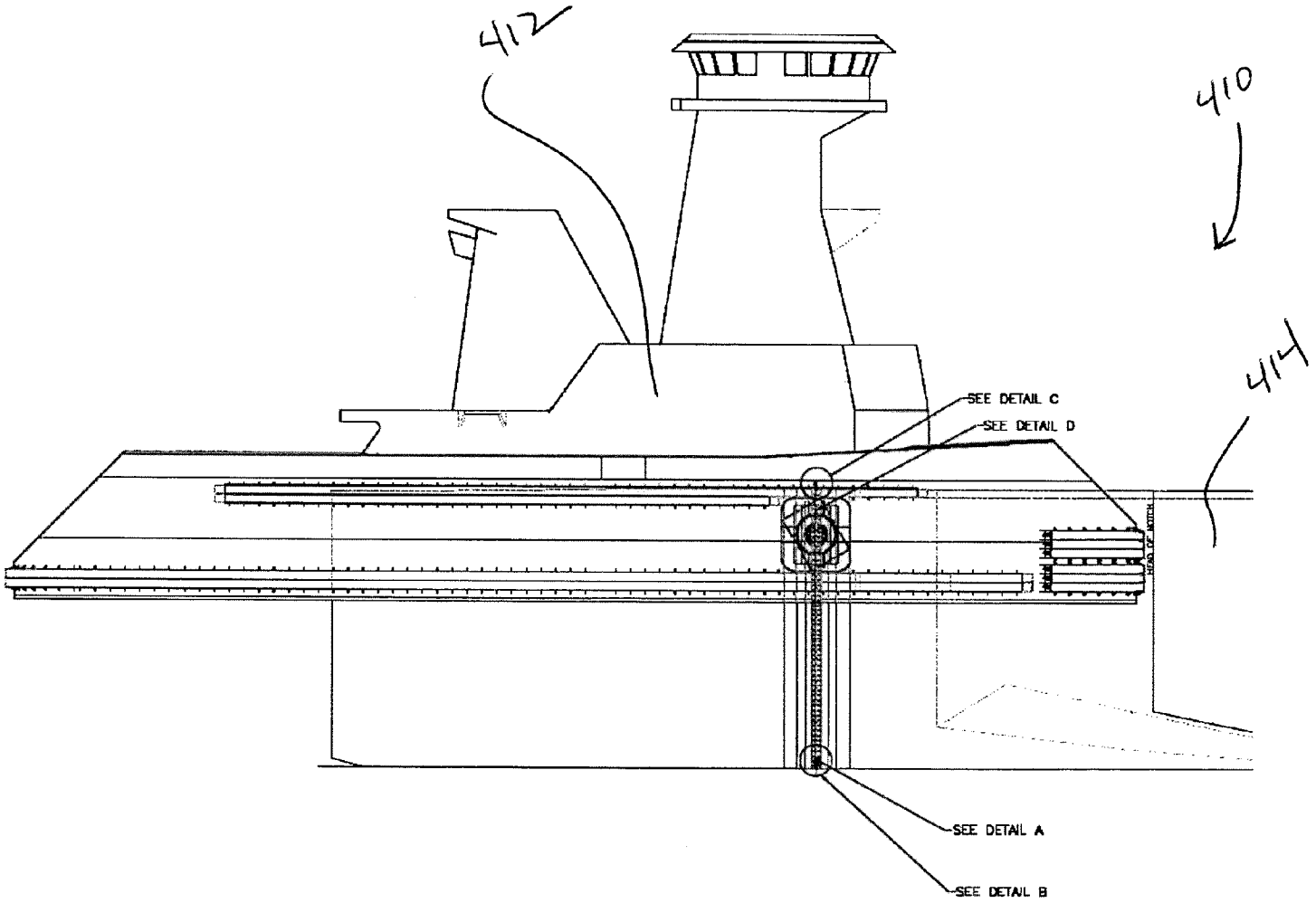
FIG. 14 is a side elevation view of the tug and the stern of the barge of FIG. 5A including portions of the coupling system according to an exemplary embodiment.

According to an exemplary embodiment, the rack pin 314 is integrated with the pressing shoe 312. In various embodiments, the rack pin 314 is configured to move relative to the pressing shoe 312, such as through an aperture 322 (FIGS. 6 and 8) in the middle of the pressing shoe 312. In various embodiments, the rack pin 314 may project forward from the pressing shoe 312 when the pressing shoe 312 is extended (FIGS. 7 and 9). In other configurations, the rack pin 314 may be retracted into the aperture 322 of the pressing shoe 312, such that the exterior face of the pressing shoe 312 is substantially flat (e.g., distal end). The rack pin 314 may be retracted when the pressing shoe 312 is retracted (FIGS. 6 and 8). In other configurations, the rack pin 314 may be retracted when the pressing shoe 312 is extended.

Referring to FIGS. 6-7, the exterior face of the pressing shoe 312 generally extends lengthwise in the vertical direction, however orientation of the pressing shoe 312 is adjustable about the main bearing 320. Supporting structure 324 (e.g., plates, reinforcements) buttress the exterior face of the pressing shoe 312, which is configured to be pressed against a second part of the coupling system (see second part 326 as shown in FIGS. 10-13). Referring to FIGS. 8-9, the exterior face of the pressing shoe 312 tapers away from the base 318. In various embodiments, the distal end of the pressing shoe 312 is flat.

Referring to FIGS. 10-13, a second part 326 (e.g., a receiving component, female connector) of the coupling system includes a channel 328 (e.g., a connecting slot or groove), an end plate 330 (e.g., contact plate, sliding surface), and a column of rack teeth 332. According to an exemplary embodiment, the rack teeth 332 are recessed with respect to the end plate 330 in the channel 328 such that the first part 310 of the coupling system is configured to slide within the channel 328 when the rack pin 314 is retracted and not engaging the rack teeth 332 of the second part 326 of the coupling system. Alternatively, it is also possible for the rack teeth 332 to be proud with respect to the end plate 330. According to an exemplary embodiment, the channel 328 is inversely tapered to receive the exterior face of the pressing shoe 312. In various embodiments, the column of rack teeth 332 is at least 20 feet long, providing a wide range of vertical connection points between the first and second parts 310, 326 of the coupling system.

In various embodiments, substantially identical copies of the first part 310 of the coupling system 218 are attached to port and starboard sides of the bow of the tug 112, and copies of the second part 326 of the coupling system are correspondingly attached to opposing sides of the interior of a notch in the periphery of the barge 114 (see, e.g., the bow 116 of the tug 112 and the notch 118 of the barge 114 as shown in FIG. 3).

Referring now to FIGS. 14-20, an articulated tug barge 410 (see also the articulated tug barge 210 of FIGS. 4A, 4B, 5A, and 5B) is configured to automatically adjust the interconnection of the coupling system 218 between the associated tug 412 and barge 414 (see, e.g., the coupling system 218 as shown in FIGS. 4A and 5A) to allow vertical movement of the tug 412 relative to the barge 414, while limiting other movement, so that the drafts of the tug 412 and barge 414 may change relative to one another without operator intervention and while the articulated tug barge 410 is operating in a seaway. In other contemplated embodiments, humans may manually control operation of the coupling system.

Figure 15:
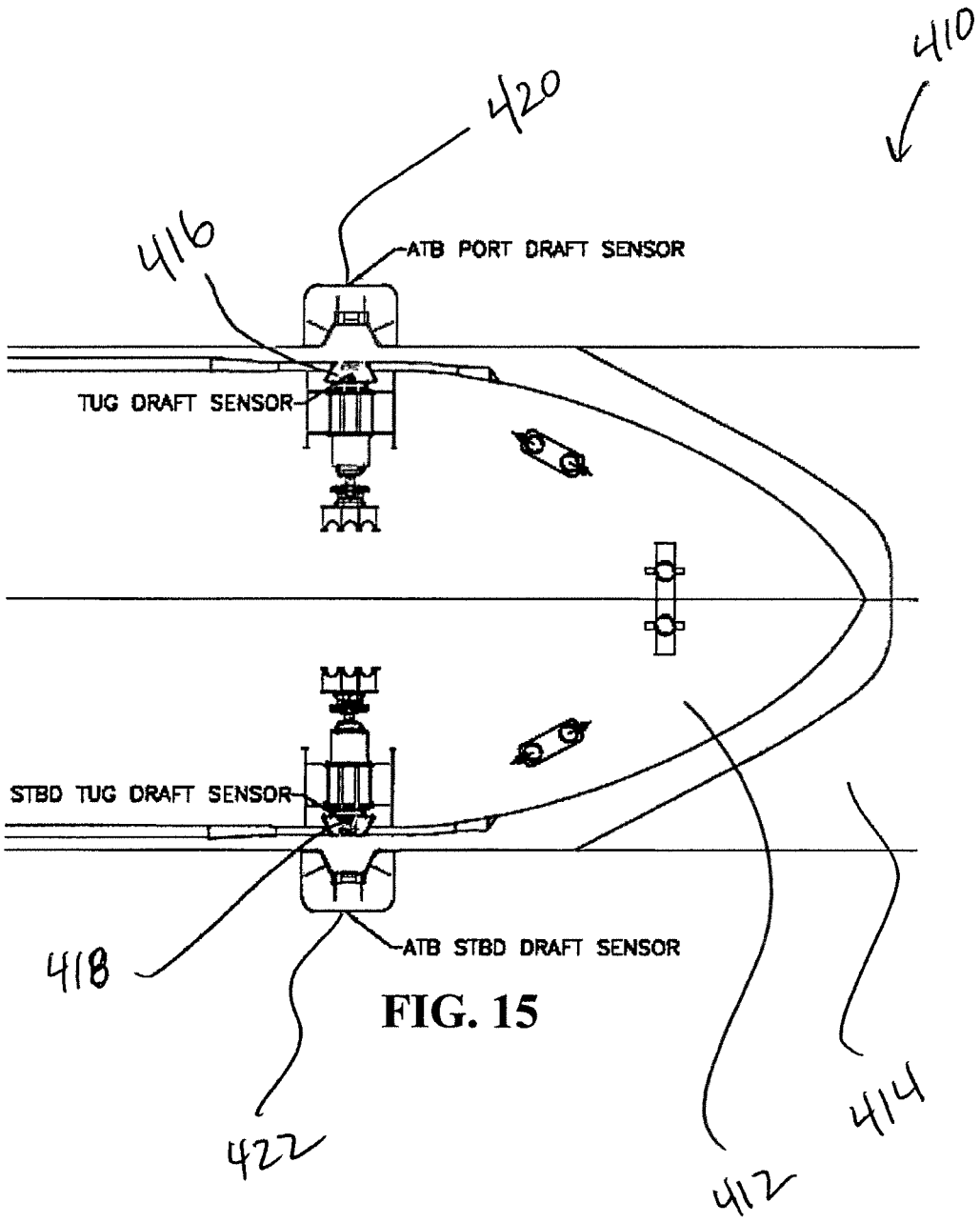
FIG. 15 is a top plan view of the stern of the articulated barge of FIG. 14 including portions of the coupling system.
Figure 16:
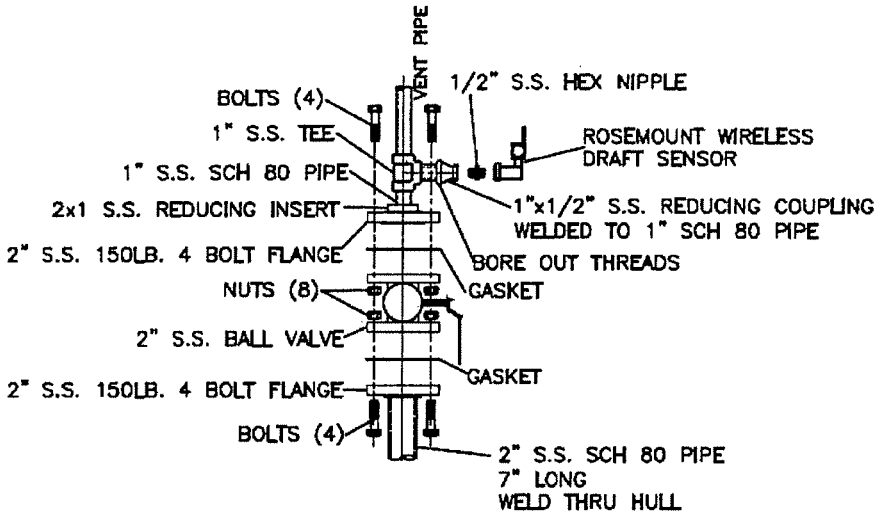
FIG. 16 is an exploded view of a draft sensor and piping assembly shown in FIG. 14.
Figure 17:
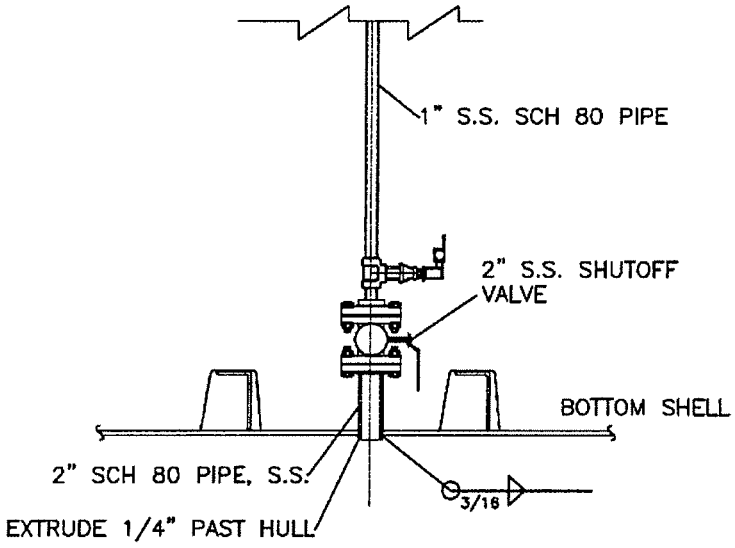
FIG. 17 is a side elevation view of a valve installation at a bottom shell shown in FIGS. 14 and 16.
Figure 18:
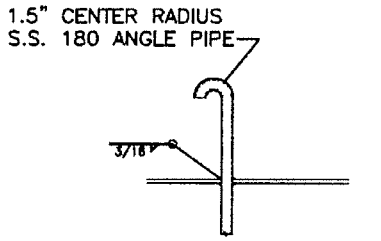
FIG. 18 is a side elevation view of a vent installation at a deck shown in FIG. 14.

Referring specifically to FIG. 15, the tug 412 includes a port draft sensor 416 and a starboard draft sensor 418, each configured to measure the draft of the tug 412. The barge 414 includes a port draft sensor 420 and a starboard draft sensor 422, each configured to measure the draft of the barge 414. The free tug float draft is generally known. In other embodiments, the tug 412 and the barge 414 may include more or fewer draft sensors, and the draft sensors may be located elsewhere on the tug 412 and the barge 414. FIGS. 16-18 show particular details corresponding to an exemplary draft sensor system. However, other draft sensor systems or components may be used.

Figure 20:
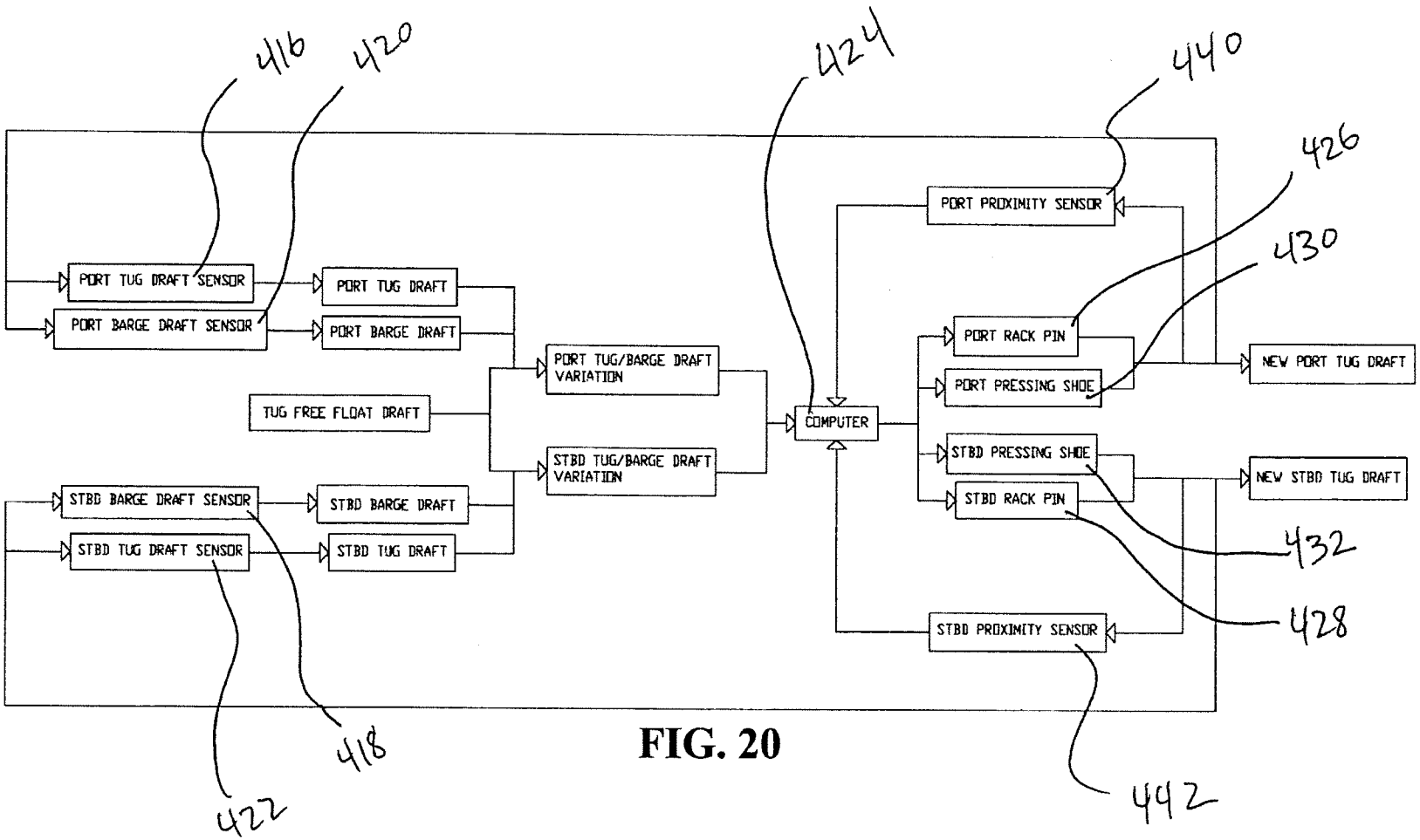
FIG. 20 is a flow chart diagram of a draft correction process for a draft adjustment system according to an exemplary embodiment.

Referring specifically to FIG. 20, in various embodiments the coupling system 218 includes a computerized controller 424 configured to interface with the draft sensors 416, 418, 420, 422, rack pins 426, 428, and pressing shoes 430, 432 in order to automatically correct variations in drafts between the tug 412 and the barge 414 of the articulated tug barge 410. Such variations may occur, for example, when the barge 414 releases dredged material carried by the barge 414 into a seaway, into open ocean, etc.

In various embodiments, the tug and barge draft sensors 416, 418, 420, 422 provide draft information to the computerized controller 424, which may include or may be used to determine a variation between drafts of the barge 414 and the tug 412 on port and starboard sides. The computerized controller 424 then determines whether the variation warrants an adjustment of the coupling system (e.g., vertical adjustment). In various embodiments, a variation of at least a threshold distance (e.g., six inches, a foot, etc.) initiates automated adjustment of the coupling system.

Figure 19:
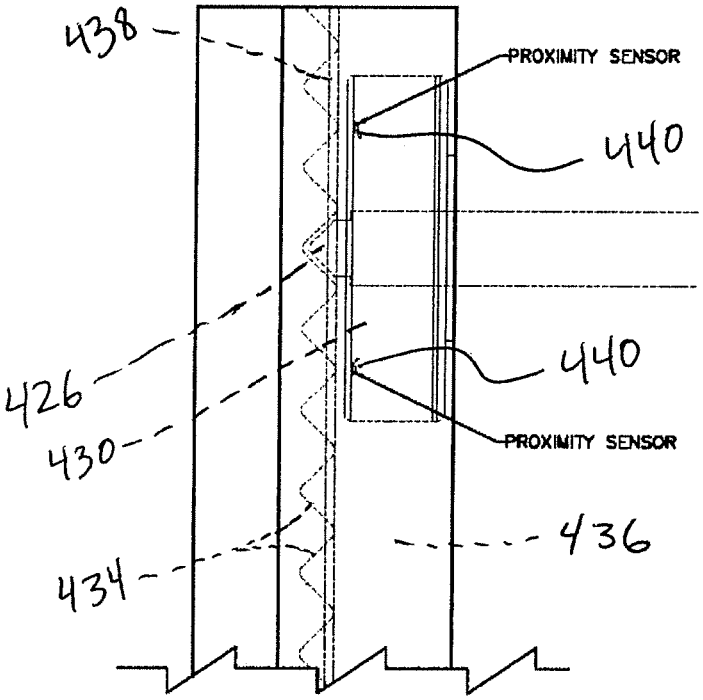
FIG. 19 is a side elevation view of a coupling system including proximity sensors shown in FIG. 14.

According to an exemplary embodiment and as shown in part in FIG. 19, the process of automated adjustment includes retracting the rack pins 426, 428 of the first part of the coupling system from the rack teeth 434 of the second part of the coupling system. The computerized controller 424 reduces pressure supplied by the pressing shoes 430, 432 against the channels 436 to allow for sliding of the pressing shoes 430, 432 within the channels 436, against the end plate 438. However, the pressing shoes 430, 432 are not fully retracted and still interconnect with the channels 436 to restrain surge, sway, yaw, and roll of the tug 412 relative to the barge 414. The weight or buoyancy of the tug 412 increases or decreases the draft of the tug 412 so that the tug 412 approximately reaches the free float draft of the tug 412.

Once the drafts of the tug 412 and barge 414 have adjusted (e.g., both within six inches of free float draft in one embodiment; within six inches of one another in another embodiment), the computerized controller 424 increases pressure between the pressing shoe 430, 432 and the channel 436. In various embodiments, the computerized controller 424 uses proximity sensors 440, 442 (also shown in FIG. 19) integrated with the coupling system to determine whether the first part of the coupling system is in proper position to interlock with the second part of the coupling system. When the position is correct, the computerized controller 424 extends the rack pins 426, 428 to engage rack teeth 434 and vertically interlock the tug 412 and barge 414 of the articulated tug barge 410.

The construction and arrangements of the articulated tug barge, coupling system, and adjustment system, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. An articulated tug barge trailing suction hopper dredge, comprising:

a tug having a bow;

a barge having a notch in a periphery thereof, the notch sized to receive the bow of the tug, the barge including dredging machinery integrated with the barge and configured to excavate material dredged from the seabed, wherein the dredging machinery includes trailing suction pipes;

a coupling system configured to selectively interconnect the tug and the barge;

at least one draft sensor located on at least one of the tug and the barge; and a computerized system configured to:

receive, from the at least one draft sensor, information associated with a draft of the tug and a draft of the barge;

determine a difference between the draft of the tug and the draft of the barge;

determine whether the difference between the draft of the tug and the draft of the barge exceeds a threshold; and in response to a determination that the difference between the draft of the tug and the draft of the barge exceeds the threshold, automatically at least partially disengage the coupling system so as to permit vertical movement of the tug relative to the barge so that the draft of the tug is approximately equal to a free float draft of the tug.

2. The articulated tug barge trailing suction hopper dredge of claim 1, wherein the computerized system is further configured to, once the draft of the tug is approximately equal to the free float draft of the tug, automatically fully reengage the coupling system so as to restrict vertical movement of the tug relative to the barge.

3. The articulated tug barge trailing suction hopper dredge of claim 2, wherein the computerized system at least partially disengages the coupling system via:

retracting at least one pin of the coupling system, the at least one pin interconnecting the tug and the barge when the tug and the barge are fully interconnected with each other;

reducing pressure applied by at least one pressing shoe of the coupling system while maintaining interconnection between the at least one pressing shoe and at least one channel, thereby allowing vertical movement of the tug relative to the barge so that the draft of the tug is approximately equal to the free float draft of the tug.

4. The articulated tug barge trailing suction hopper dredge of claim 3, wherein the computerized system reengages the coupling system via:

increasing pressure between the at least one pressing shoe and the at least one channel of the coupling system;

determining whether the at least one pin is properly aligned; and upon determining that the at least one pin is properly aligned, extending the at least one pin to interlock the tug and the barge, thereby limiting relative vertical movement between the tug and the barge.

5. The articulated tug barge trailing suction hopper dredge of claim 4, wherein the computerized system is further configured to allow the weight or buoyancy of the tug to adjust the draft of the tug to the free float draft before increasing pressure between the at least one pressing show and the at least one channel of the coupling system.

6. The articulated tug barge trailing suction hopper dredge of claim 4, further comprising at least one proximity sensor located on at least one of the tug and the barge, and wherein the computerized system uses the at least one proximity sensor to determine whether the at least one pin is properly aligned.

7. The articulated tug barge trailing suction hopper dredge of claim 2, wherein the at least one draft sensor comprises two draft sensors located on the tug and two draft sensors located on the barge.

8. A method for correcting variation in drafts between a tug and a barge of an articulated tug barge, comprising:

receiving, from at least one draft sensor, information associated with a draft of the tug and a draft of the barge;

determining a difference between the draft of the tug and the draft of the barge;

determining whether the difference between the draft of the tug and the draft of the barge exceeds a threshold; and in response to determining that the difference between the draft of the tug and the draft of the barge exceeds the threshold, automatically at least partially disengaging the coupling system so as to permit vertical movement of the tug relative to the barge so that the draft of the tug is approximately equal to a free float draft of the tug.

9. The method of claim 8, further comprising, once the draft of the tug is approximately equal to a free float draft of the tug, automatically reengaging the coupling system so as to restrict vertical movement of the tug relative to the barge.

10. The method of claim 9, wherein the at least partial disengagement of the coupling system comprises:

retracting at least one pin of a coupling system that interconnects the tug and the barge; and reducing pressure applied by at least one pressing shoe of the coupling system while maintaining interconnection between the at least one pressing shoe and at least one channel to allow vertical movement of the tug relative to the barge so that the draft of the tug is approximately equal to a free float draft of the tug.

11. The method of claim 10, wherein the reengaging of the coupling system comprises:

increasing pressure between the at least one pressing shoe and the at least one channel of the coupling system;

determining whether the at least one pin is properly aligned; and upon determining that the at least one pin is properly aligned, extending the at least one pin to interlock the tug and the barge, thereby limiting relative vertical movement between the tug and the barge.

12. The method of claim 11, wherein at least one proximity sensor is used to determine whether the at least one pin is properly aligned.

13. The method of claim 11, further comprising allowing the weight or buoyancy of the tug to adjust the draft of the tug to the free float draft before increasing pressure between the at least one pressing show and the at least one channel of the coupling system.

14. The method of claim 10, wherein at least one computerized controller is configured to interface with the at least one draft sensor, the at least one pin, and the at least one pressing shoe so as to automate the method.

15. The method of claim 8, wherein the at least one draft sensor comprises two draft sensors located on the tug and two draft sensors located on the barge.

16. A computerized system for correcting variation in drafts between a tug and a barge of an articulated tug barge, comprising:

a processor; and at least one memory unit communicatively connected to the processor and including computer code therein, the at least one memory unit and the computer program code configured to, with the at least one processor:

process information received from at least one draft sensor, the information associated with a draft of the tug and a draft of the barge;

determine a difference between the draft of the tug and the draft of the barge;

determine whether the difference between the draft of the tug and the draft of the barge exceeds a threshold; and in response to a determination that the difference between the draft of the tug and the draft of the barge exceeds the threshold, at least partially disengage a coupling system used to couple the tug and the barge, the at least partial disengagement of the coupling system thereby permitting vertical movement of the tug relative to the barge so that the draft of the tug is approximately equal to a free float draft of the tug.

17. The computerized system of claim 16, wherein the at least one memory unit and the computer program code are further configured to, with the at least one processor, following vertical movement of the tug relative to the barge, automatically reengage the coupling system so as to restrict vertical movement of the tug relative to the barge.

18. The computerized system of claim 17, wherein the at least partial disengagement of the coupling system comprises:

retracting at least one pin of the coupling system, the at least one pin interconnecting the tug and the barge when the tug and the barge are fully engaged with each other; and reducing pressure applied by at least one pressing shoe of the coupling system while maintaining interconnection between the at least one pressing shoe and at least one channel, thereby allowing vertical movement of the tug relative to the barge so that the draft of the tug is approximately equal to the free float draft of the tug.

19. The computerized system of claim 18, wherein the automatic reengaging of the coupling system comprises:

once the draft of the tug is approximately equal to the free float draft of the tug, increasing pressure between the at least one pressing shoe and the at least one channel of the coupling system;

determining whether the at least one pin is properly aligned; and upon determining that the at least one pin is properly aligned, extending the at least one pin to interlock the tug and the barge, thereby limiting relative vertical movement between the tug and the barge.

* * * * *

UNITED STATES PATENT AND TRADEMARK OFFICE

CERTIFICATE OF CORRECTION

PATENT NO. : 9,061,742 B2
APPLICATION NO. : 13/567842
DATED : June 23, 2015
INVENTOR(S) : Steve Becker, David Coombs and Paul LaMourie It is certified that error appears in the above-identified patent and that said Letters Patent is hereby corrected as shown below:

In the claims

Column 7, claim 5, line 38, “show” should be --shoe--.

Column 8, claim 13, line 28, “show” should be --shoe--.

Signed and Sealed this
First Day of December, 2015

Michelle K. Lee

Michelle K. Lee
*Director of the United States Patent and Trademark Office*